US005555809A

United States Patent [19]

Hirt et al.

[11] Patent Number: 5,555,809

[45] Date of Patent: Sep. 17, 1996

[54] ERASABLE PRINTING FORM

[75] Inventors: Alfred Hirt, München; Barbara Nüssel, Friedberg; Robert Weiss, Gersthofen, all of Germany

[73] Assignee: MAN Roland Druckmaschinen AG, Offenbach A.M., Germany

[21] Appl. No.: 465,132

[22] Filed: Jun. 5, 1995

Related U.S. Application Data

[62] Division of Ser. No. 139,527, Oct. 20, 1993, Pat. No. 5,454,318.

[30] Foreign Application Priority Data

Oct. 20, 1992 [DE] Germany ..... 42 35 242.8

[51] Int. Cl.[6] ..... B41N 1/14; B41N 3/03

[52] U.S. Cl. ..... 101/451; 101/452; 101/465; 101/466; 101/478

[58] Field of Search ..... 101/450.1, 451, 101/452, 453–456, 458, 459, 463.1, 465–467, 478; 347/163, 164, 165; 346/150.3

[56] References Cited

U.S. PATENT DOCUMENTS

| | | | |
|---|---|---|---|
| 3,935,327 | 1/1976 | Taylor | 101/467 |
| 4,263,387 | 4/1981 | Martinez | 101/465 |
| 4,833,990 | 5/1989 | Hirt et al. | 101/467 |
| 4,872,962 | 10/1989 | Scheer et al. | 101/467 |
| 4,959,668 | 9/1990 | Hirt | 101/467 |
| 5,145,758 | 9/1992 | Kossmehl et al. | 101/463.1 |
| 5,191,834 | 3/1993 | Fuhrmann et al. | 101/467 |
| 5,194,881 | 3/1993 | Hirt | 101/463.1 |

FOREIGN PATENT DOCUMENTS

| | | | |
|---|---|---|---|
| 48947 | 2/1990 | Japan | 101/467 |

*Primary Examiner*—Stephen Funk
*Attorney, Agent, or Firm*—Cohen, Pontani, Lieberman, Pavane

[57] ABSTRACT

A method for producing an erasable printing form by making the outer layer of the printing form from a material containing strong micro-dipoles, preferably a ferroelectric material, in particular a ferroelectric ceramic. In wet offset printing, the non-printing areas of the printing form are rendered hydrophilic by a hydrophilizing agent and they are maintained during the entire printing process. Plate cleaners can, for example, be used as the hydrophilizing agents. The printing form can be erased by a nonpolar solvent and can be reused again by rendering the non-printing areas hydrophilic again.

9 Claims, 1 Drawing Sheet

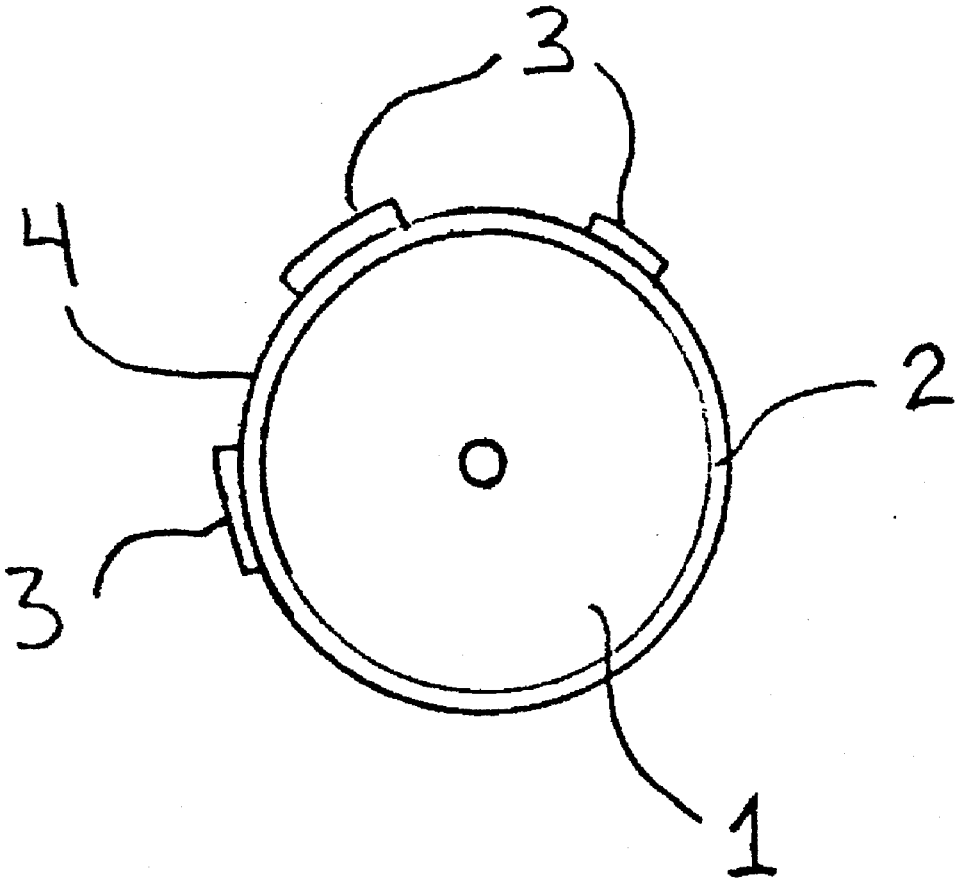
3
4
2
O
3
1

ERASABLE PRINTING FORM

This is a divisional of application Ser. No. 08/139,527, filed Oct. 20, 1993 issued as U.S. Pat. No. 5,454,318.

BACKGROUND OF THE INVENTION

Field Of The Invention

The invention concerns a process for producing an erasable printing form, a method for erasing the printing form, the printing form itself, as well as its use for coating a roller.

DESCRIPTION OF THE PRIOR ART

In modern offset printing processes which employ a moistening agent to moisten the printing form, a photopolymer is applied to a hydrophilic (water-accepting) surface of the printing form and is first exposed and then developed to form images. In so doing, hydrophobic (ink-accepting) image locations corresponding to an image to be printed are left behind on the surface of the printing form, while the photopolymer is removed from the non-image locations. The surface of the material forming the printing form is freed again at the non-image locations as a result of the developing step. The printing form is formed e.g. by a roughened aluminum plate on which an aluminum oxide ($Al_2O_3$) layer has been applied anodically. The aluminum oxide layer has a porous surface which promotes the adhesion of a hydrophobic coating and, moreover, stores moistening agent in the pores and accordingly improves the hydrophilic properties.

However, this aluminum oxide layer has the disadvantage that a polymer layer which is applied to it can be removed again only with difficulty if the printing form is to be used repeatedly. In order to clean the capillaries in the surface of the aluminum oxide layer so as to rid them of residues interfering with a subsequent printing process, deep-acting cleansers must be used in a lengthy cleaning process. Under certain circumstances, these cleansers could also attack the aluminum oxide layer and shorten its useful life.

On the other hand, a printing form is known from DE 36 33 758 A1 on which hydrophobic and hydrophilic areas can be formed and which contains a material with ferroelectric characteristics. This material can be polarized and depolarized in selected areas or can be brought to the three different polarization states (positive or negative polarization or depolarization). The printing form is polarized by applying an electrical d.c. voltage to an electrode and using an electrically conductive layer beneath the ferroelectric material as a counter-electrode.

Conversely, the printing form can be depolarized again by means of alternating voltage whose frequency is far greater than the natural or resonant frequency of the ferroelectric material or by heating to a temperature above the Curie temperature or can be uniformly polarized again by subsequent application of a d.c. voltage. Barium titanate, for example, whose Curie temperature is greater than 120° C., can be used as a ferroelectric material. Other materials having ferroelectric properties can also be used instead of barium titanate, e.g. a composite material with hydrophobic properties such as soft-plastic matting with embedded ferroelectric micro-crystallites.

However, a disadvantage in the previous known methods for rendering printing forms with ferroelectric properties reusable for offset printing is that either a current source and a counter-electrode must be brought to the printing form or a heat source is required. The ferroelectric layers must be thin to prevent unnecessarily high electrical voltage.

SUMMARY OF THE INVENTION

Accordingly, it is an object of the present invention to provide a process for producing an erasable printing form which can be made reusable for offset printing in a simple manner.

Pursuant to this object, and others which will become apparent hereafter, one aspect of the present invention resides in a method for producing a printing form for wet offset printing, in which a masking material is applied to the printing form according to imaged areas. The non-image areas are then rendered hydrophilic by a hydrophilizing agent.

In another embodiment of the invention the masking material is hydrophobic.

An additional embodiment of the invention involves applying the masking material by thermo-transfer, ink jet coating or static toner transfer. The masking material can also be applied by applying a layer of photopolymers and subsequently removing the layer during development so as to distinguish between image areas.

Another aspect of the invention involves a method for printing which utilizes the printing form described above and applies a hydrophilizing agent to the printing form during a production run. The hydrophilizing agent can be applied in combination with a moistening agent. Alternatively, the hydrophilizing agent can be rubbed or sprayed on the outer layer of the form.

The present invention also involves a method for erasing a printing form, which method includes cleaning the form with a solvent and applying a non-polar solvent to the form to render it hydrophobic again. The initial cleaning solvent can be acetone and the non-polar solvent can be an isoparaffinic hydrocarbon.

A further object of the present invention is to provide an erasable printing form for use in the method mentioned above.

This object is met by an erasable printing form with an outer layer having strong micro-dipoles.

According to a further embodiment of the invention, the layer with strong micro-dipoles is used as a coating of a roller in a moistening apparatus or an inking apparatus.

The invention is advantageous in that the hydrophilic regions maintain their hydrophilic properties even after more than 10,000 cylinder revolutions and in that the print image is not changed when the material applied for masking the ink-accepting image areas is removed during the printing process, since the base material of the printing form which is exposed in so doing is hydrophobic. Even a deliberate removal of the material applied for masking the ink-accepting image areas with solvents, e.g. acetone, does not affect the print image. However, if the material masking the image areas is maintained, the hydrophilic areas can be reconditioned at any time or can be rendered hydrophilic continuously by additions to the moistening agent. A particular advantage in the use of a ferroelectric layer as a layer with strong micro-dipoles consists in that it can be permanently polarized and in that hydrophilizing agents can be bonded in the polarized areas in a determined manner. Since the non-polarized areas are hydrophobic, the coating need not be resistant to repeated print runs. Nevertheless, ferroelectric layers for producing image areas can also be coated. With polarized material, the coating can also be reconditioned again at any time.

It is particularly advantageous that the surface of the outer layer be very smooth, which can be achieved by polishing with a fine-grained polishing agent, and that it be nonporous. In contrast to known printing plates with porous surfaces, the hydrophilizing agent in the printing form according to the present invention is held on the smooth, nonporous surface by intensive electrostatic forces.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWING

The FIGURE shows an end view of the printing form.

DETAILED DESCRIPTION OF THE PREFERRED EMBODIMENTS

A material 2 containing strong micro-dipoles is used for producing the printing form 1. The electric fields of the unordered (non-polarized), but still effective, micro-dipoles are sufficient for tightly bonding substances having a hydrophilic effect to the surface so that a hydrophilic layer is formed which can only be removed with difficulty during the printing process. It is not necessary to apply an electric field externally. Since only the micro-dipoles are needed for adhesion, it is not absolutely necessary that the material be amenable to polarization in its entirety, i.e., it does not have to be ferroelectric, for example. It is sufficient that it have sufficiently strong micro-dipoles.

For example, aluminum titanate is such a material, although it is not ferroelectric. However, ferroelectric materials in particular have strong micro-dipoles, e.g. barium titanate, lead zirconium titanates or, as plastic material, polyvinylidine fluoride which is a ferroelectric polymer. The outer layer of the printing form need not be made exclusively of a ferroelectric material. On the contrary, it is sufficient if ferroelectric micro-crystallites are embedded in a soft-plastic material or form a composite with a non-ferroelectric material such as glass, hard plastics or ceramics. For ceramics, a sintered ceramic is preferable, but dense ceramic layers produced by thermal spraying methods are also suitable. On the whole, nonporous materials having a smooth surface are suitable. The outer layer is provided with a smooth surface e.g. by polishing with a polishing agent having a grain of less than 20 μm.

For wet offset printing, a reusable printing form is produced in that the non-image locations 4 of a hydrophobic printing form, whose image locations are masked by a masking material 3 and which has a layer, according to the invention, with strong micro-dipoles, are rendered hydrophilic by rubbing them with a hydrophilizing agent. The hydrophilizing agent is preferably a plate cleaner commonly used in offset printing technique. Such plate cleaners are known e.g. from SU 42 97 485 A or from DE 31 17 358 A1 and DE 34 01 159 A1. The plate cleaners contain e.g. orthophosphoric acid, silicates, nonionic surfactants and long-chain hydrocarbons. Such plate cleaners were formerly used only for cleaning pre-coated aluminum offset printing plates.

However, when such a plate cleaner is used as a hydrophilizing agent on the non-image portions of a printing form containing strong micro-dipoles, this printing form becomes hydrophilic and its hydrophilic property is maintained during an entire printing process. This is also true for large print runs, e.g. with more than 10,000 cylinder revolutions. The surface of the printing form has a low sensitivity to fluctuations in the pH of the moistening agent. Accordingly, even pure tap water without any additives can be used as a moistening agent.

The image areas are erased by stripping off any remaining masking material from the image locations and by canceling the hydrophilic property of the non-image areas. The process of forming a hydrophilic surface on the printing surface for generating the non-image locations can easily be reversed again by treating with a nonpolar solvent. Solvents for liquid toners known from electrophotography which are essentially a mixture of long-chain, branched aliphatic, liquid—i.e. isoparaffinic—hydrocarbons are suitable for this purpose. In this way a reversibly hydrophilic and hydrophobic surface of a printing form can be provided which is erasable and accordingly reusable. In particular, highly polished printing forms of ferroelectric material are often reusable.

A printing form is prepared for the printing process by applying masking material to the hydrophobic, ink-accepting surface of the outer layer according to desired image locations. All methods in which material is applied to the surface to differentiate between image areas and non-image areas are suitable for this purpose. The masking material itself is preferably hydrophobic. Examples of such methods are thermotransfer, ink jet coating, and electrostatic toner transfer, in which thermoplastic layers, inks from ink jets which absorb color by application of heat or charged toner particles by depositing on electrically charged surfaces are transmitted and then fixed, as well as the application of photopolymers with subsequent removal of the layer during development so as to distinguish between image locations. The portions of the surface not carrying images are then rendered hydrophilic by the hydrophilizing agent.

A particular characteristic of the ferroelectric layer consists in that its surface is initially hydrophobic before being treated. The pictorial or image unit must therefore prevent or resist the coating of the image areas with the hydrophilizing agent only for the hydrophilizing process which is effected only once for each printing process. The printing form is rendered hydrophilic by spraying the hydrophilizing agent, e.g. a plate cleaner, onto the outer layer from jets. In another method, the hydrophilizing agent is rubbed on the outer layer. However, a hydrophilizing agent can also be applied to the printing form during the production run, e.g. as an additive in the moistening agent, so as to improve the print quality.

Even if the image layer is partially removed during printing, e.g. as a result of insufficient resistance to print runs or intentionally by means of a solvent such as acetone, this does not affect the printed image. At the end of the printing process, the printing form can be cleaned in its entirety with a solvent, e.g. acetone, and restored to its original hydrophobic state by means of a nonpolar solvent, e.g. an isoparaffinic hydrocarbon. The cleaning can be carried out without removing the printing form from the printer. For example, it can be carried out with the same cleaning devices used for washing the rubber-blanketed cylinder.

The printing form is either a plate which can be tensioned on a form cylinder or is constructed as a cylindrical sleeve of a form cylinder without grooves.

If the ferroelectric material is a sintered ceramic or is embedded in a hard ceramic, the printing form has a particularly long useful life due to the hard, abrasion-resistant ceramic surface.

An erasable printing form having strong dipoles at least in its outer layer can be also produced for dry offset printing. Masking material is applied corresponding to the image areas and non-image areas are then rendered oil-repellent by an oil-repelling agent. For example, a liquid silicone is a suitable oil repellent.

The ability to deposit electrically active substances on a ferroelectric layer allows this ferroelectric layer to be used not only as an erasable printing form, but also in applications in which the effect of the uppermost layer on a surface, is decisive for the surface characteristics. These surface characteristics are e.g. surface tension, stickiness or adhesion which can be controlled within defined limits by purposeful depositing of layers and in some cases can be regenerated. Accordingly, the effect of the moistening agent on the rollers of the moistening apparatus or that of the printing ink on the rollers of the inking apparatus can also be controlled in a printer.

Accordingly, a printing form can be produced pursuant to the invention which can be provided with images and can be erased again in a simple manner without having to remove it from the printer. A good adhesiveness of the image locations is unimportant since the surface of the ferroelectric material is hydrophobic, i.e. ink-accepting, without any treatment. The non-image areas which are made hydrophilic by the hydrophilizing agent have a high resistance to print runs. The printing form preferably encloses the entire outer surface of the form cylinder so that the latter has no tensioning groove. The characteristics of the moistening agent, e.g. its pH, can fluctuate within wide limits without a deterioration in print quality.

The invention is not limited by the embodiments described above which are presented as examples only but can be modified in various ways within the scope of protection defined by the appended patent claims.

We claim:

1. A method for printing, comprising the steps of: providing an erasable printing form having an outer layer having a hydrophobic surface and micro-dipoles at least in the outer layer, the micro-dipoles having a strength sufficient for tightly bonding an agent having a hydrophilic effect to the surface, the printing form being produced by applying a masking material to the hydrophobic surface according to the image areas; and applying a hydrophilizing agent to the printing form during a production run to render non-image areas hydrophilic.

2. A method according to claim 1, wherein the step of applying a hydrophilizing agent includes applying a moistening agent to the printing form, the hydrophilizing agent being an additive of the moistening agent.

3. A method according to claim 1, wherein the step of applying a hydrophilizing agent includes rubbing the hydrophilizing agent on the outer layer of the printing form.

4. A method according to claim 1, wherein the step of applying a hydrophilizing agent includes spraying the hydrophilizing agent on the outer layer of the printing form.

5. A method for erasing an ink-containing printing form having an outer layer having a hydrophobic surface and dipoles at least in the outer layer, the micro-dipoles having a strength sufficient for tightly bonding an agent having a hydrophilic effect to the surface, which printing form is produced by applying a masking material to the hydrophobic surface of the printing form according to image areas, and rendering non-image areas hydrophilic with a hydrophilizing agent, the erasing method comprising the steps of: cleaning the ink from the printing form with a solvent; and applying a nonpolar solvent to the printing form so as to render it hydrophobic again.

6. A method according to claim 5, wherein the solvent is acetone.

7. A method for erasing a printing form according to claim 5, wherein the nonpolar solvent is an isoparaffinic hydrocarbon.

8. A method for producing an erasable printing form for dry offset printing, comprising the steps of: providing an outer layer and micro-dipoles at least in the outer layer, the micro-dipoles having a strength sufficient for tightly bonding an agent having an oil-repellent effect to the outer layer; applying a masking material to the outer layer corresponding to image areas; and rendering non-image areas oil-repellent with an oil-repelling agent.

9. A method according to claim 8, wherein the oil-repelling agent is a liquid silicone.

* * * * *